US005872491A

United States Patent [19]

Kim et al.

[11] Patent Number: 5,872,491

[45] Date of Patent: Feb. 16, 1999

[54] SWITCHABLE N-WAY POWER DIVIDER/ COMBINER

[75] Inventors: Duk Yong Kim, Hwasung-Kun; Ik Soo Chang, Seoul, both of Rep. of Korea

[73] Assignee: KMW USA, Inc., Santa Fe Springs, Calif.

[21] Appl. No.: 757,503

[22] Filed: Nov. 27, 1996

[51] Int. Cl.[6] ..... H01P 1/10

[52] U.S. Cl. ..... 333/101; 333/105; 333/125

[58] Field of Search ..... 333/101, 1, 105, 333/108, 124, 125, 127, 128, 136; 330/51, 124 D

[56] References Cited

U.S. PATENT DOCUMENTS

| | | | |
|---|---|---|---|
| 3,091,743 | 5/1963 | Wilkinson | 333/127 |
| 4,129,839 | 12/1978 | Galani et al. | 333/128 |
| 4,315,222 | 2/1982 | Saleh | 333/1.1 |
| 4,367,445 | 1/1983 | Dydyk | 333/127 |
| 4,595,891 | 6/1986 | Cronauer | 333/127 |
| 4,641,106 | 2/1987 | Belohoubeck et al. | 330/286 |
| 4,697,160 | 9/1987 | Clark | 333/103 |
| 4,755,769 | 7/1988 | Katz | 330/295 |
| 4,780,685 | 10/1988 | Ferguson | 330/124 D |
| 4,875,024 | 10/1989 | Roberts | 333/127 |
| 5,021,755 | 6/1991 | Gustafson | 333/128 |
| 5,256,987 | 10/1993 | Kibayashi et al. | 333/51 X |
| 5,304,943 | 4/1994 | Koontz | 330/51 |
| 5,363,072 | 11/1994 | Sakamoto et al. | 333/125 |
| 5,410,281 | 4/1995 | Blum | 333/127 |
| 5,418,490 | 5/1995 | Kaegebein | 330/124 D |
| 5,438,684 | 8/1995 | Schwent et al. | 455/89 |
| 5,455,546 | 10/1995 | Frederick et al. | 333/128 |

OTHER PUBLICATIONS

E. Wilkinson, "An N–Way Hybrid Power Divider," IRE Transactions on Microwave Theory and Techniques, vol. MTT–8, Jan. 1960, pp. 116–118. (Published by IRE in USA).

K. Russel, "Microwave Power Combining Techniques," IEEE Transactions on Microwave Theory and Techniques, vol. MTT–27, No. 5, May 1979, pp. 472–478. (Published by IEEE U.S.A.).

A. Saleh, "Planar Electrically Symmetric n–Way Hybrid Power Dividers/Combiners," IEEE Transactions on Microwave Theory and Techniques, vol. MTT–28, No. 6, Jun. 1980, pp. 555–563. (Published by IEEE in U.S.A.).

*Primary Examiner*—Robert J. Pascal
*Assistant Examiner*—Seungsook Ham
*Attorney, Agent, or Firm*—Jacobson, Price, Holman & Stern, PLLC

[57] ABSTRACT

An improved Wilkinson-type power divider/combiner possessing switching capabilities for selectively controlling operative modes of its constituent dividing/combining channels is disclosed. The switchable power divider/combiner includes N first switches connecting N input/output transmission lines to a common junction and N second switches connecting N isolation resistors coupled to the N input/output transmission lines to a common node. The operating mode of the power divider/combiner can be controlled by activating each pair of the first and second switches to a closed or open switch position. The impedance values of the dividing/combining channel transmission lines are adjusted to provide the optimal impedance matching in both N-way and (N–1)-way operating modes. The resulting switchable power divider/combiner is capable of providing efficient power combining and distribution in a low-loss, phase-balanced manner in both N-way and (N–1)-1 way modes. When one of the signal-processing channels in the dividing/combining system fails, the power divider/combiner is switched to the (N–1)-way mode to provide continuing operation of the system without any degradation in the signal characteristics.

23 Claims, 8 Drawing Sheets

SWITCHABLE N-WAY POWER DIVIDER/ COMBINER

BACKGROUND OF THE INVENTION

1. Field of the Invention

This invention relates generally to the field of power dividers or combiners in RF or microwave frequencies and, in particular, to an N-way power divider/combiner possessing switching capabilities for selectively controlling operative modes of its constituent dividing/combining channels.

2. Description of the Prior Art

RF or microwave power divider/combiners are used in the electronics industry to either divide or combine RF or microwave signals. When operating as a power divider, one input signal is divided into a plurality of output signals, each retaining the same signal characteristics but having a lower power level than the input signal. As a power combiner, a plurality of input signals is combined into a single output signal, with the output signal having the signal characteristics of the sum of the plurality of input signals. Thus, a divider/combiner can operate as either a power divider or a power combiner, depending on the direction of the signals.

In a typical application in RF or microwave systems, a divider/combiner used as a power divider divides an input signal into a plurality of equi-phase, equi-amplitude signal outputs for amplification by power amplifiers and, when used as a power combiner, combines the outputs of several power amplifiers together to attain a useful power output. In such systems, it is usually desired that if one of the individual amplifiers fails, the system can continue to operate with a minimum reduction in the system output power and with a minimum degradation in the signal characteristics. Therefore, it is advantageous that the power divider/combiner exhibits a low overall power loss, is symmetrical in configuration to avoid phase and amplitude imbalances, and provides sufficient isolation and impedance matching between its output ports (or input ports). Furthermore, the characteristics of low loss, electrical symmetry, isolation and impedance matching should be maintained in a normal operating mode as well as in the presence of a failed amplifier in order to prevent the failure of a single amplifier from seriously degrading the performance of the divider/combiner circuitry or the remaining amplifiers.

A low-loss power divider/combiner which utilizes a circular or radial symmetry and provides isolation and impedance matching is described in an article entitled "An N-Way Hybrid Power Divider" by E. J. Wilkinson, IRE Transactions on Microwave Theory and Techniques, vol. MTT-13, pp.116–118, January 1960. FIG. 1 shows a schematic representation of a conventional Wilkinson hybrid power divider. Although the Wilkinson divider in FIG. 1 is depicted in a four-way configuration, its operation will be described, for the purpose of generality, in terms of an N-way device.

In an N-way Wilkinson hybrid divider 10, as shown in FIG. 1, an RF signal fed into an input port 12 with an input impedance $Z_0$ is divided into N equi-phase, equi-amplitude signals by way of N transmission lines 14 each having an electrical length of one-quarter wavelength ($\lambda/4$) at the operating frequency. The output end of each transmission line 14 is further coupled to each of N output ports 16 having an output impedance $Z_0$. Isolation between the N output ports 16 is accomplished by means of N resistors 18 each connected between the output end of each transmission line 14 and a common node 20, and having a resistance $R_0$. When the characteristic impedance Z of the N transmission lines 14 is set to $\sqrt{N}Z_0$ and $R_0$ is equal to $Z_0$, the output ports 16 are optimally matched and isolated. As a result, no power is dissipated in the resistors 18 and 1/N of the input power is delivered to each of the N output ports 16. Likewise, when used as a power combiner, the Wilkinson arrangement can combine N RF input signals of power $P_{in}$ applied to the previously called N output ports 16 into an output signal of power $N \times P_{in}$ if the input signals are in phase and of equal amplitude. However, if the input signals are not equi-phase equi-amplitude, a substantial portion of power is dissipated by the resistors 18 and the power delivered to the previously called input port 12 will be reduced accordingly.

Several modified versions of the Wilkinson divider/combiners are known in the prior art. U.S. Pat. No. 5,410,281, issued to Blum, discloses a high power combiner/divider which provides effective cooling of the isolation resistors by locating the resistors remote from the body of the device using extended transmission lines. Additional Wilkinson-type divider/combiners, including planar radial hybrids and "fork" hybrids, are described in an article, "Planar Electrically Symmetric n-way Hybrid Power Dividers/Combiners" by Adel A. M. Saleh, IEEE Transactions on Microwave Theory and Techniques, vol. MTT-28, pp. 555–563, June 1980. FIG. 2 and FIG. 3 show the schematic representation of a prior art radial hybrid and a fork hybrid, respectively. Several variations of the planar radial/fork hybrids of the Wilkinson-type are also disclosed in U.S. Pat. No. 4,129,839 to Galani, U.S. Pat. No. 5,021,755 to Gustafson, and U.S. Pat. No. 5,455,546 to Frederick et al.

The conventional hybrid power divider/combiners, such as the Wilkinson divider, suffer from several shortcomings. When one of the N signal-processing channels coupled to the divider outputs experiences a failure or malfunctions, such as in an amplifier failure, the conventional hybrid power divider continues to distribute the power to the disabled channel and 1/N of the power is lost through the disabled channel. In a multi-channel divider/combiner network, the failure of an operating channel also introduces a mismatch between output or input impedances of the divider/combiner, which degrades the overall performance characteristics of the network. Another significant disadvantage of the conventional Wilkinson hybrid is that when used as a combiner, if one or more of the power amplifiers in the combiner network fail, any imbalance in the output voltages of the power amplifiers induces voltages across the isolation resistors, further reducing the combiner output power as the power from the remaining operational amplifiers is divided between the isolation resistors and the combiner circuit. For a network combining N power amplifiers, the decrease in power ($P_d$) resulting from disabling M of the N power amplifiers is given by the equation, $P_d$ (dB)=10 log$((N-M)/N)^2$. Thus, when one of the amplifiers fails in a two-amplifier combining network, the output power of the conventional hybrid combiner drops not by 3 dB, but by 6 dB. Such additional power loss is unacceptable in many applications and results in excessive heat dissipation in isolation resistors, limiting the power handling capabilities of the combiner, especially in high power situations. Although Blum's patent attempts to ameliorate some of the problems arising from the excessive heat dissipation in the resistors, it does not solve any of the more fundamental shortcomings herein described.

The conventional Wilkinson hybrids also present serious packaging problems. In practice, the device is difficult to realize in a planar structure when N is greater than 2 as the resistors need to be connected to a floating common node. For example, in microstrip versions, such Wilkinson hybrids are subject to signal crossover and cross coupling, which adversely affect the isolation characteristics of the circuit. Although the radial or fork hybrids of Galani, Gustafson, and Frederick attempt to solve some of these problems, they still suffer from the impedance mismatching and the inefficient power distribution/combining in a failure mode. Furthermore, the conventional Wilkinson hybrids do not provide enough room for internally accommodating the means for individually controlling the dividing/combining channels, such as RF switches, due to the structural limitations in packaging the resistors and the physical proximity of the transmission lines and the resistors.

What is needed is an improved power divider/combiner which can be operated in a normal operating mode as well as in the presence of a failed channel, which can maintain the impedance lo matching of the circuitry and achieve efficient power combining and distribution even in the failure mode, and which can be easily implemented without the structural and physical limitations of the conventional Wilkinson divider/combiners.

SUMMARY OF THE INVENTION

The present invention overcomes the preceding and other shortcomings of the prior art by providing an improved Wilkinson power divider/combiner possessing mode-switching capabilities, wherein the operative mode of each one of N constituent dividing/combining channels can be selectively controlled by activating associated control switches.

In a first aspect, the present invention provides a switchable power divider/combiner comprising a common transmission line extending to a common junction, N input/output transmission lines, N first switchable transmission line arrangements, and N switchable resistor arrangements. Each first switchable transmission line arrangement is coupled to each corresponding input/output transmission line at one end and includes a first switch disposed at the other end. Each first switch is operable in two switch positions; in a closed switch position, each first switch electrically connects each first switchable transmission line arrangement to the common junction and, in an open switch position, breaks the electrical connection to the common junction. Each switchable resistor arrangement includes a resistor coupled to a corresponding input/ output transmission line and a second switch disposed between the resistor and a common node. Each second switch is also operable in two switch positions; in the closed switch position, each second switch electrically connects each resistor to the common node and, in the open switch position, breaks the electrical connection to the common node. Control means coupled to each first and second switches provides means for selecting one of two switch positions. In a preferred embodiment, the common transmission line and N input/output transmission lines have a same characteristic impedance equal to a selected impedance $Z_0$, and N first switchable transmission line arrangements are designed to have a characteristic impedance Z, where Z is equal to $(\sqrt{N}+\sqrt{N-1})Z_0/2$, and be a quarter-wavelength long at a selected frequency within the operating frequency range. N resistors have a same resistance $R_0$ equal to the selected impedance $Z_0$.

In another aspect, the present invention provides a switchable power divider/combiner further including N additional transmission lines each inserted between each resistor and the corresponding second switch. Each additional transmission line is preferably an integer multiple of a half-wavelength long at the selected operating frequency. This arrangement is advantageous in that it provides sufficient physical space for accommodating multiple RF switches and resistors within the device, while satisfying the isolation conditions of the conventional Wilkinson divider.

In a further aspect, the present invention provides a switchable power divider/combiner in a radial configuration wherein each one of the N additional transmission lines are inserted between each successive pair of N connecting nodes to form a ring. Each second switch disposed between the corresponding resistor and one of the N connecting nodes electrically connects the corresponding resistor to the corresponding connecting node in the closed switch position and breaks the electrical connection to the corresponding connecting node in the open switch position. Each additional transmission line is preferably an integer multiple of one-wavelength long at the selected operating frequency in order to provide a same potential at each connecting node.

In a still further aspect, the present invention utilizes an electrically symmetrical configuration wherein each one of the N dividing/combining channel circuits is radially disposed around an axis connecting the common junction and the common node, and equally spaced apart from each adjoining one. With this radial arrangement, the present invention can be generally implemented in any N-way configuration while maintaining electrical symmetry among the constituent dividing/combining channels.

In operation, the present invention can be used as an N-way power divider/combiner by setting the first and second switches of each one of the N dividing/combining channels to the closed switch position. When a particular one of the N dividing/combining channels needs to be disabled due to a failure in the external circuitry, the first and second switches of the particular dividing/combining channel are activated to the open switch position, transforming the operating mode of the power divider/combiner from N-way into (N−1)-way. Since the characteristic impedance Z of the dividing/combining channels is chosen to be intermediate to those of the N-way and (N−1)-way Wilkinson divider arrangements, $\sqrt{N}Z_0$ and $\sqrt{N-1}Z_0$, respectively, there is no appreciable change in the impedance matching, or in the resulting signal characteristics, of remaining operative channels when the operating mode of the divider/combiner changes from N-way to (N−1)-way. The power combining efficiency in the failure mode is significantly improved as no power is lost through the decoupled isolation resistor associated with the failed channel. The resulting switchable power divider/combiner of the present invention provides efficient power combining and distribution in a low-loss, phase-balanced manner, in both N-way and (N−1) −1 way operating modes, thus enabling the continuing operation of the power divider/combiner network despite the failure of a channel therein.

These and other features and advantages of this invention will become further apparent from the detailed description and accompanying drawing figures that follow. In the figures and description, numerals indicate the various features of the invention, like numerals referring to like features throughout both the drawings and the description.

DETAILED DESCRIPTION OF THE PREFERRED EMBODIMENTS

Figure 1:
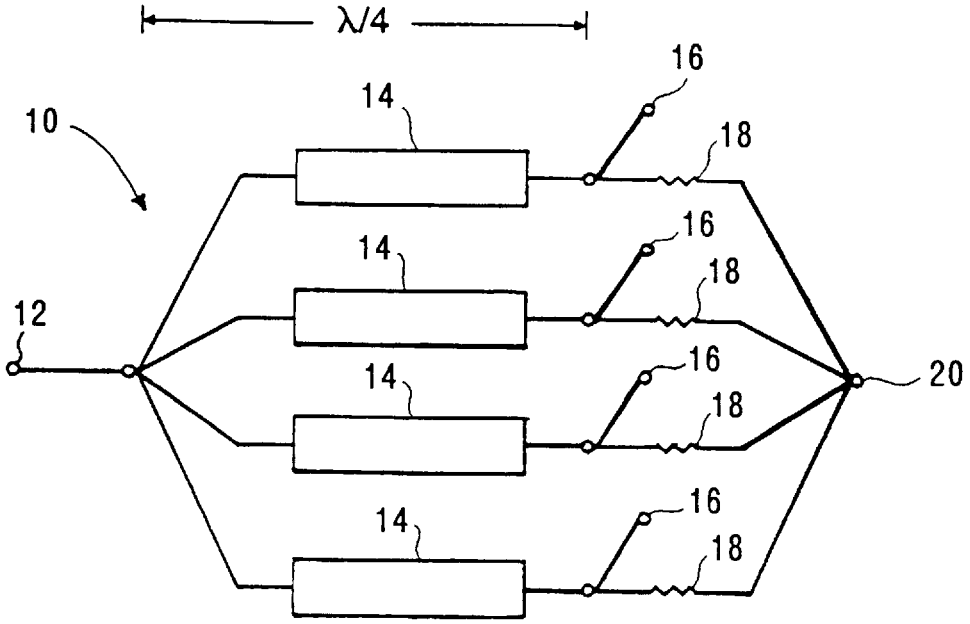
FIG. 1 (PRIOR ART)
FIG. 1 is a schematic representation of a prior art Wilkinson hybrid power divider/combiner.
Figure 2:
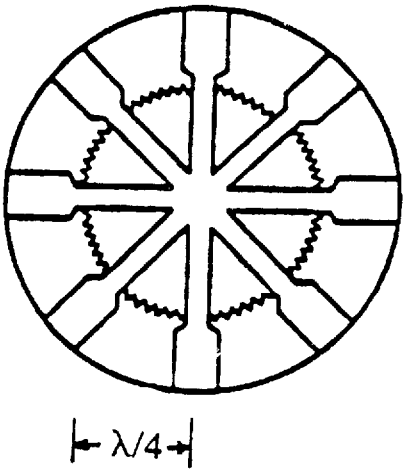
FIG. 2 (PRIOR ART)
FIG. 2 is a schematic representation of a prior art radial hybrid power divider/combiner.
Figure 3:
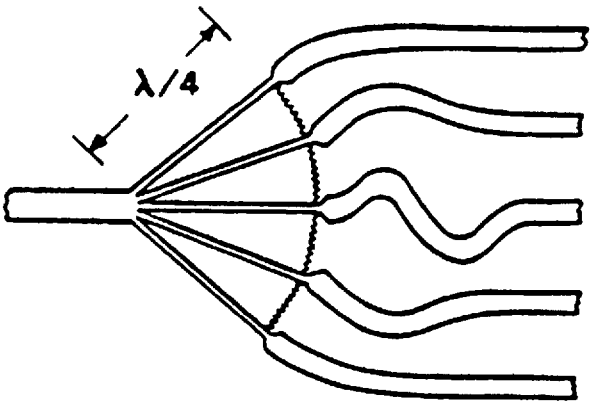
FIG. 3 (PRIOR ART)
FIG. 3 is a schematic representation of a prior art fork hybrid power divider/combiner.
Figure 4:
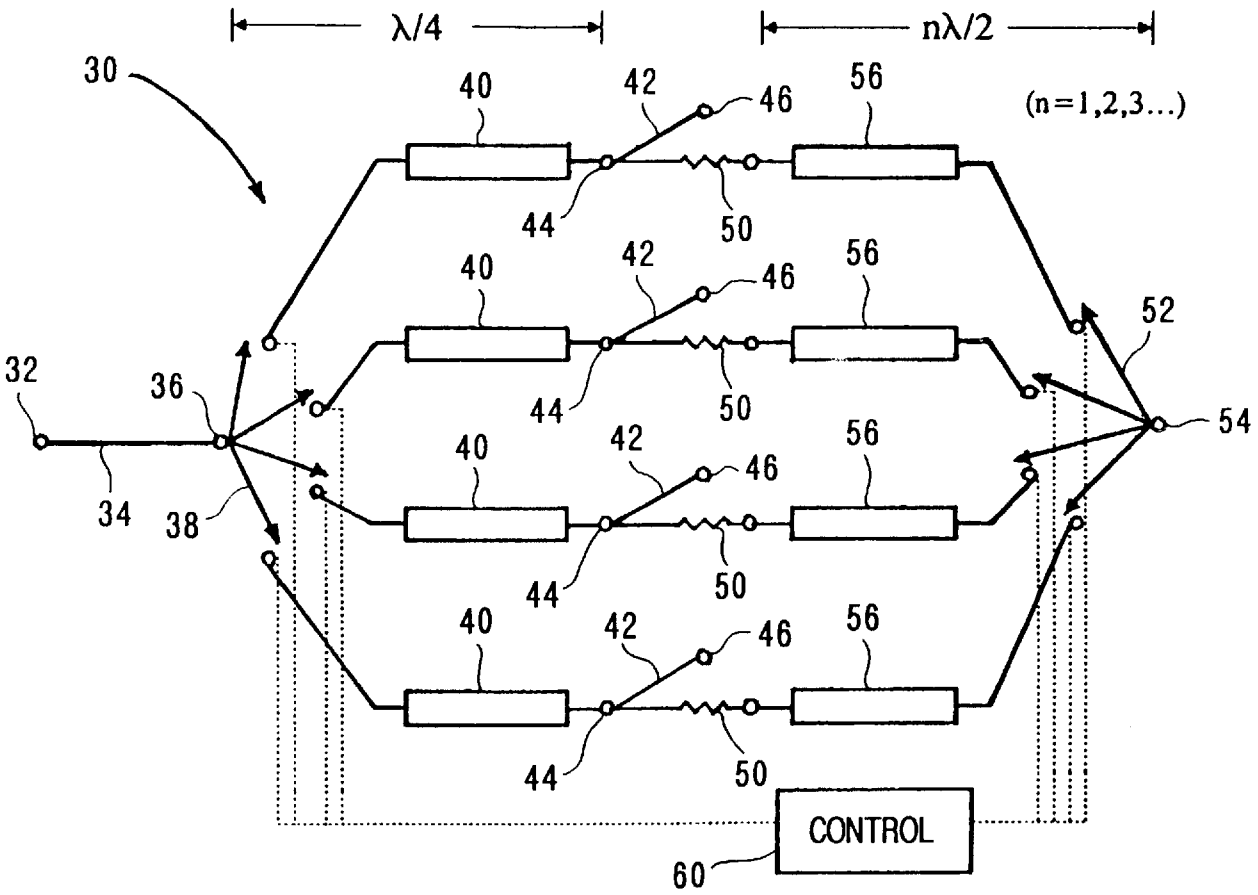
FIG. 4 is a schematic representation of a switchable power divider/combiner according to the present invention.

A schematic representation of a four-way switchable power divider/combiner of the present invention is set forth in FIG. 4. Although a four-way configuration is shown for the purpose of illustration, the power divider/combiner of the present invention can be generally implemented as an N-way device, where N is any integer number greater than 1. Therefore, in the figures and description, the power divider/combiners of the present invention will be described, and their elements referred to, in terms of an N-way device.

As is true for power dividers or combiners generally, the present invention can serve as either a power divider or power combiner depending upon the choice of ports for the input(s) and the output(s). Turning to FIG. 4, if a common port 32 is chosen to be an input port for receiving an RF signal, the switchable power divider/combiner 30 operates as a divider to equally divide the signal between N input/output ports 46. When operated as a combiner, N input/output ports 46 are used as input ports for coupling N RF input signals and the combined output will appear at the common port 32. Thus, the terminology "divider" and "combiner" and the designation of "input" and "output" are somewhat arbitrary and therefore will be used interchangeably depending on the context in which they are used.

Referring now to FIG. 4, the common port 32 couples one end of a common transmission line 34 to the external circuit having a source (or load) impedance equal to a selected impedance $Z_0$. The selected impedance $Z_0$ is typically 50 ohms, but other impedance values may be chosen. The other end of the common transmission line 34 defines a common junction 36. The common transmission line 34 could be any type of RF transmission line having a characteristic impedance equal to the selected impedance $Z_0$.

The switchable divider/combiner 30 includes N first switches 38 each disposed between the common junction 36 and a corresponding one of N first transmission lines 40. Each first switch 38 is selectively operable in two switch positions; in a "closed" switch position, the first switch 38 makes an electrical connection between the common junction 36 and one end of the corresponding first transmission line 40 and, in an "open" switch position, the first switch 38 breaks the electrical connection between the common junction 36 and said end of the corresponding first transmission line 40. The other end of each first transmission line 40 is coupled to a corresponding one of N input/output transmission lines 42 at respective input/output junctions 44. The input/output transmission lines 42 could be any type of RF transmission lines having a substantially same characteristic impedance equal to the selected impedance $Z_0$. Each of N input/output ports 46 couple the corresponding input/output transmission line 42 to the external circuit having a load or source impedance equal to the selected impedance $Z_0$.

Each first switch 38, when electrically connected between the common junction 36 and the corresponding first transmission line 40 in the closed switch position, acts as an RF transmission line which, in conjunction with the corresponding first transmission line 40, forms a dividing/combining transmission line extending from the common junction 36 to the input/output junction 44. Each of these dividing/combining transmission lines has a substantially same characteristic impedance Z, where Z is a selected impedance between $Z_0$ and $\sqrt{N}Z_0$ and chosen to optimize the impedance matching upon the mode transition between the selected modes in which the power divider/combiner is intended to operate. For a power divider/combiner designed to operate in N-way and (N−1)-way modes, Z is chosen to be between $\sqrt{N}Z_0$ and $Z_0$. In a preferred embodiment, Z is set to be substantially equal to $(\sqrt{N}+\sqrt{N-1})Z_0/2$, which is the average of the characteristic impedances of the conventional N-way and (N−1)-way Wilkinson power dividers. Each of these dividing/combining transmission lines is preferably substantially a quarter-wavelength ($\lambda/4$) in length, but could be any odd integral multiple of the quarter-wavelength long, at a selected frequency within the operating frequency band.

The switchable power divider/combiner 30 further includes N resistors 50 each coupled between each input/output junction 44 and each one of N second switches 52. The resistors 50 have a substantially same resistance $R_0$, where $R_0$ is substantially equal to $Z_0$. The N second switches 52 are further coupled to a common node 54 to provide electrical interconnectability between the resistors 50. Each second switch 52, like the first switch 38, is selectively operable in two switch positions; in the closed switch position, each second switch 52 makes an electrical connection between each associated resistor 50 and the common node 54 and, in the open switch position, each second switch 52 breaks the electrical connection between each associated resistor 50 and the common node 54.

In practice, the conventional Wilkinson arrangement, due to the location and topology of its resistors, can only provide limited physical space for accommodating multiple switching devices in the immediate vicinity of the resistors, especially as N becomes greater. In order to overcome such physical limitation, it is desirable to provide additional transmission line sections between the resistors 50 and the common node 54. In one embodiment of the present invention, N second transmission lines 56 of an appropriate electrical length are inserted between the resistors 50 and the second switches 52 to provide sufficient room for easy fabrication and assembly of the second switches 52 within the device. Each of these second transmission lines 56, in conjunction with the corresponding second switch 52 operating in the closed switch position, forms an isolation transmission line extending from the resistor-connected end of the second transmission line 56 to the common node 54. The electrical length and the characteristic impedance of the isolation transmission lines may be adjusted to optimize isolation between the N input/output ports 46. In a preferred embodiment, each isolation transmission line is substantially an integer multiple of a half-wavelength ($\lambda/2$) long at the selected frequency.

The present switchable power divider/combiner 30 further provides control means 60 coupled to the first and second switches 38, 52 for controlling their respective switch positions. The control means 60 can be adapted to receive bias voltages, logic signals, or telemetry data for controlling the respective switch positions and may include switch driver circuits and logic circuits for providing operating voltages for the first and second switches 38, 52.

Both the first and second switches 38, 52 can be any suitable RF switches or relays having the desired RF and impedance characteristics. It is generally desirable that the first and second switches 38, 52 are located as close as possible to the common junction 36 and the common node 54, respectively, so that the open-positioned first or second switch 38, 52 does not present an open impedance stub "hanging" at the common junction 36 or the common node 54. In a preferred embodiment, the first and second switches 38, 52, when in the open switch position, are completely disassociated from the common junction 36 and the common node 54, respectively, so that no portion of the first and second switches 38, 52 are in electrical contact with the common junction 36 and the common node 54, respectively. With this arrangement, the impedance matching of the operative channels are not adversely affected by any of the first and second switches 38, 52 set in the open switch position.

In operation, when used as an N-way power divider, an RF signal applied to the common port 32 travels across the common transmission line 34 and is evenly divided at the common junction 36 among the N first transmission lines 40 via the N first switches 38 operating in the closed switch position. The evenly divided signals are then routed to the N input/output transmission lines 42 for coupling to the external circuit at the N input/output ports 46. Isolation between the N input/output ports 46 are provided by the N resistors 50 coupled to the common node 54 via the N second switches 52 operating in the closed switch position and the associated second transmission lines 56. Likewise, when used as an N-way power combiner, a series of RF signals can be fed into the N input/output ports 46 to produce a combined output at the common port 32.

When any one of the N signal-processing channels in the external circuit suffers a failure or needs to be disabled for some reasons, the N-way switchable power divider/combiner 30 can be transformed immediately into the (N−1)-way mode by activating the first and second switches 38, 52 associated with the troubled channel into the open switch position. Because the dividing/combining channel circuits associated with the troubled channel are completely removed from the divider/combiner circuitry when the corresponding first and second switches 38, 52 are activated to the open switch position, the configuration of the divider/combiner becomes identical to that of an (N−1)-way divider/combiner operating in a normal mode. Since the characteristic impedance Z of the N-way switchable divider/combiner is intermediate to those of the conventional N-way and (N−1)-way Wilkinson dividers, $\sqrt{N}Z_0$ and $\sqrt{N-1}Z_0$, respectively, there is no appreciable change in the impedance matching, or in the resulting signal characteristics, of the remaining operative channels when the operating mode of the power divider/combiner changes from N-way to the (N−1)-way. In addition, since the characteristic impedance Z of the N-way switchable divider/combiner is close enough to the ideal characteristic impedances of the N-way and (N−1)-way Wilkinson dividers, any adverse effects on the overall divider/combiner characteristics are negligible. With such an arrangement, the amplitude and phase balance of the signals passing through the contemplated circuitry are maintained, and the isolation characteristics of the Wilkinson arrangements are preserved, because all of the operative channels, whether in the N-way or (N−1)-way mode, are electrically symmetrical and isolated fully from each other.

With the illustrated arrangement and control, the power divider/combiner of the present invention is capable of operating in a failure mode without degrading the impedance matching and the signal characteristics of other operative channels. In the same way, the device may be operated in an (N−2)-way mode by activating a second set of the first and second switches to the open switch position. The impedance matching of the remaining operative channels in the (N−2)-way mode, however, will be somewhat degraded because of the greater deviation of the characteristic impedance Z of the N-way switchable divider/combiner from the ideal Wilkinson characteristic impedance in the (N−2)-way mode. As the number of the non-operative dividing/combining channels increases, additional degradation of the impedance matching among the operative channels is inevitable and, as a result, the divider/combiner characteristics will suffer accordingly.

Figure 5:
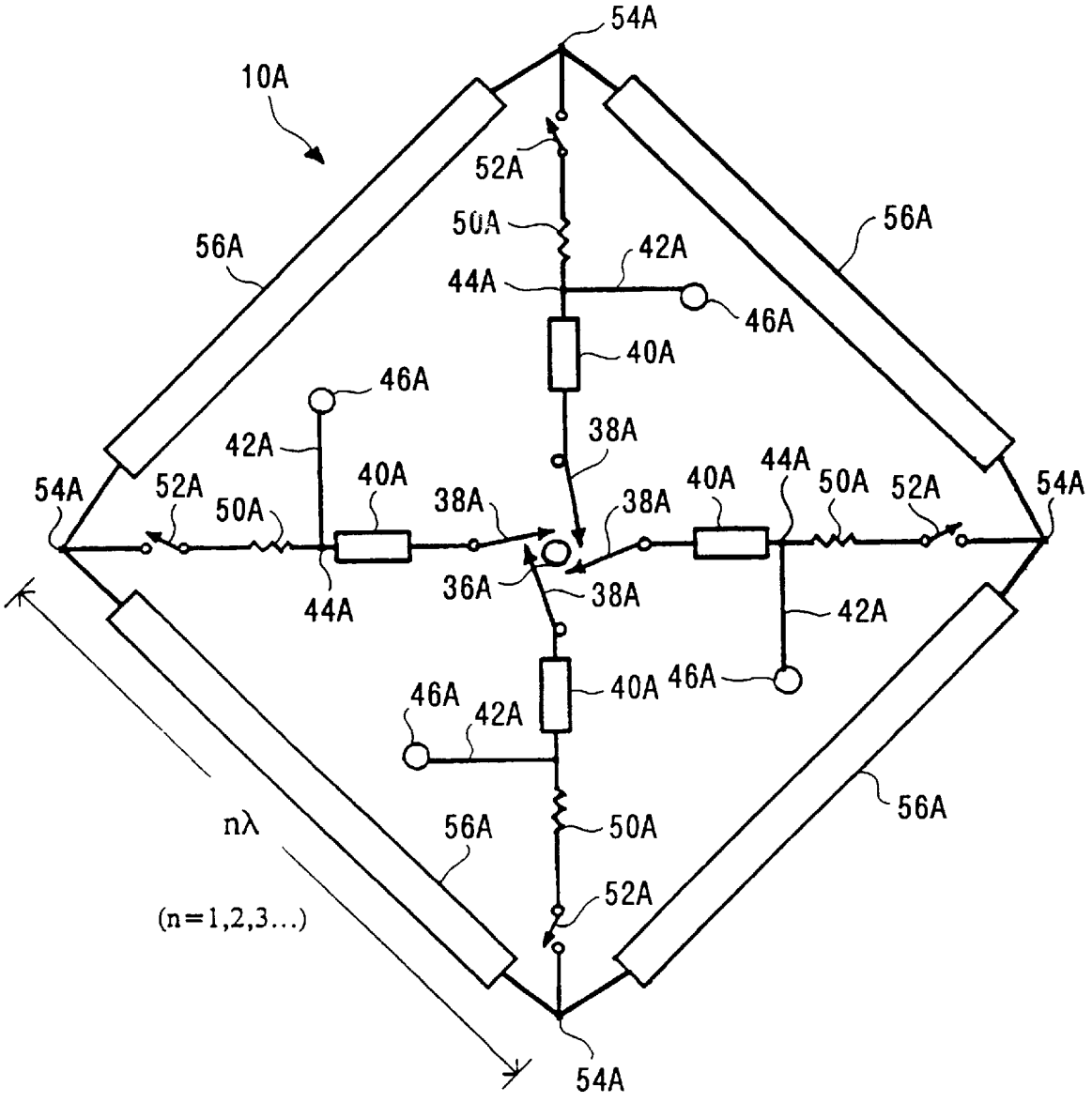
FIG. 5 is an alternate embodiment of the switchable power divider/combiner according to the present invention.

FIG. 5 shows an alternate embodiment of the switchable power divider/combiner utilizing a radial configuration. For the purposes of comparison, the elements of FIG. 5 corresponding to those of FIG. 4 are designated by the same reference numerals followed by the letter A. Referring to FIG. 5 in comparison with FIG. 4, the switchable divider/combiner 10A is identical in configuration and operation to that of FIG. 4 except that each one of N second switches 52A are connected to a corresponding one of N connecting nodes 54A instead of being connected to the common node 54, and that the N second transmission lines 56 inserted between the resistors 50 and the second switches 52 have been deleted and each one of N new second transmission lines 56A have been inserted between each successive pair of the N connecting nodes 54A to form a ring. Each second transmission line 56A is preferably substantially an integer multiple of one-wavelength (λ) long at the selected operating frequency to provide a same potential at each connecting node 54A. With this radial arrangement, each resistor 50A and the associated second switch means 52A are not connected to a single common node 54, and thus a planar version of the present invention can be implemented.

Figure 6:
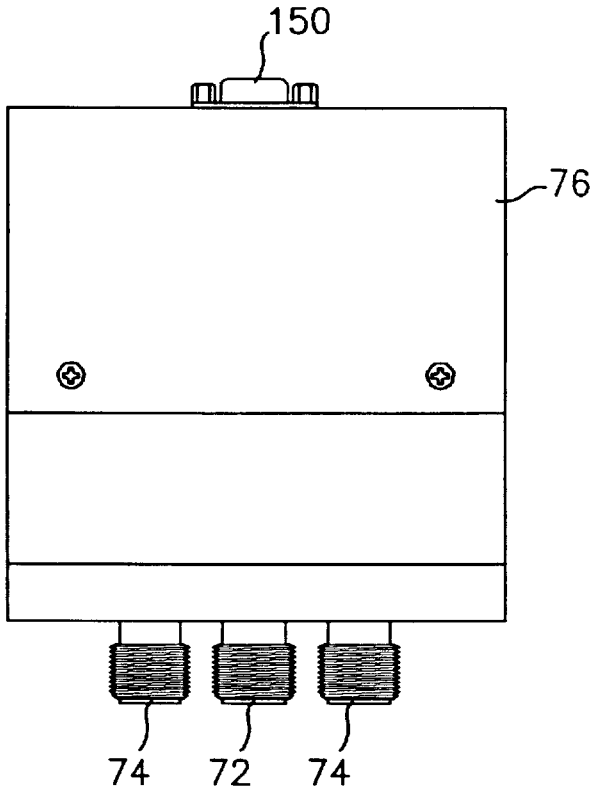
FIG. 6 is a top exterior view of the presently preferred embodiment of the switchable power divider/combiner shown in a two-way configuration.
Figure 7:
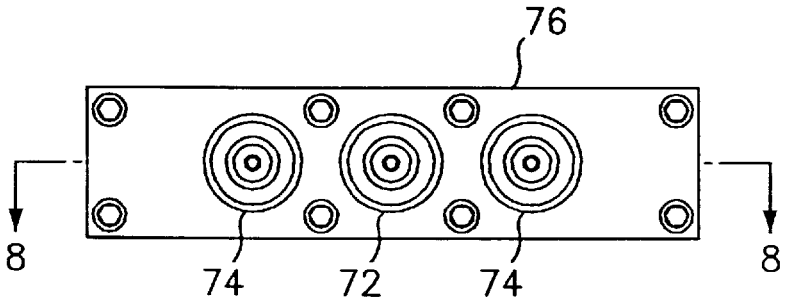
FIG. 7 is a front exterior view of the switchable power divider/combiner shown in a two-way configuration.
Figure 8:
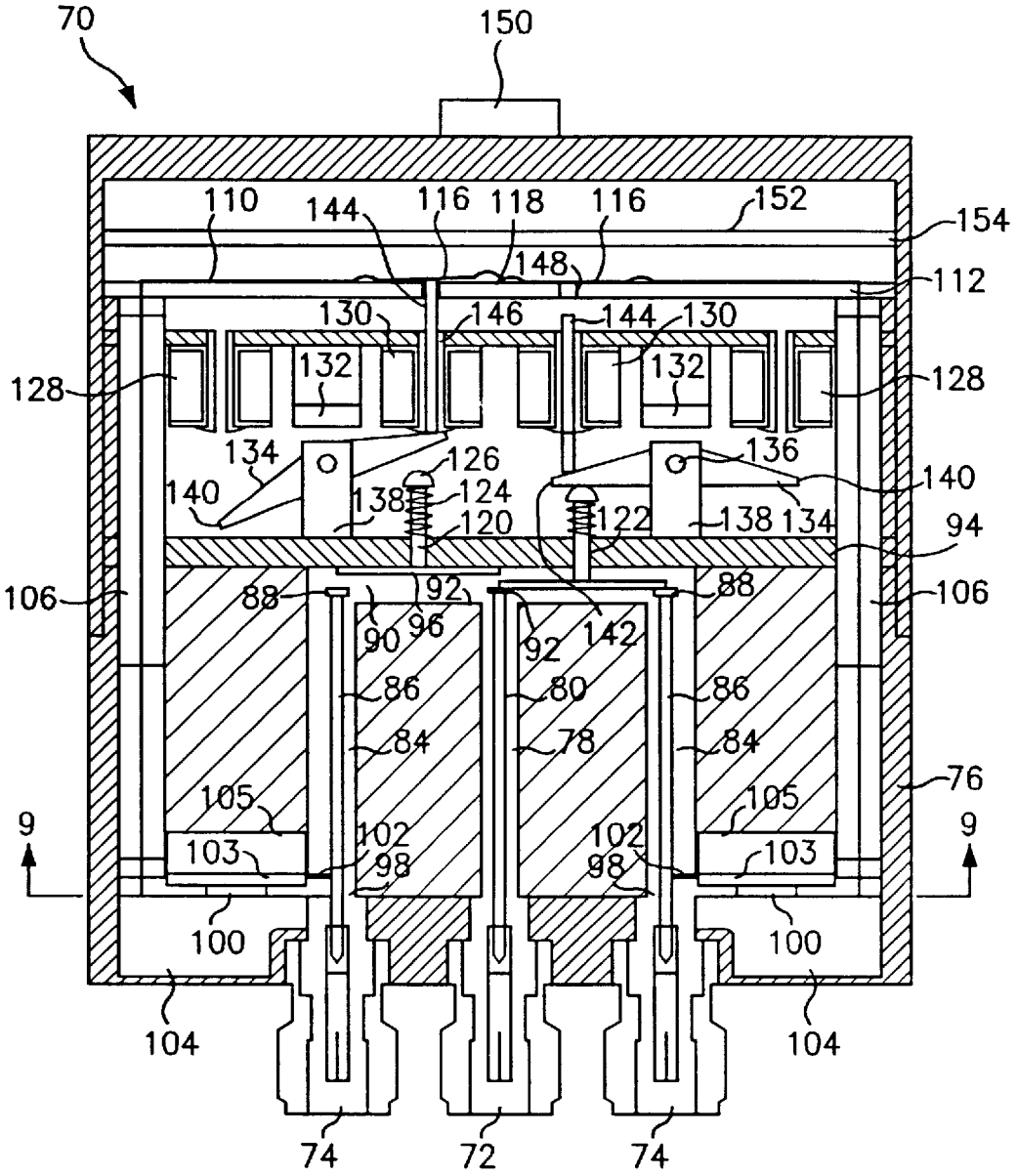
FIG. 8 is a simplified cross-sectional view taken along the lines 8—8 of FIG. 7.
Figure 9:
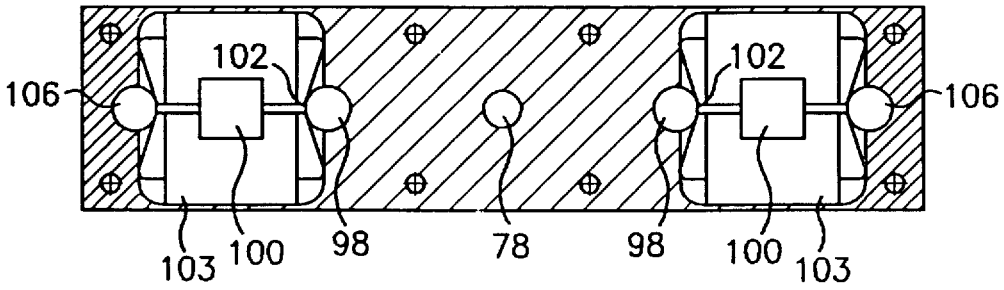
FIG. 9 is a simplified cross-sectional view taken along the lines 9—9 of FIG. 8.

FIGS. 6–9 show the presently preferred embodiment of a two-way switchable divider/combiner of the present invention, incorporating the design of FIG. 4. FIG. 6 and FIG. 7 are the top and front exterior views, respectively, of the present embodiment showing RF connectors in a two-way configuration. FIG. 8 is a simplified cross-sectional view taken along the lines 8—8 of FIG. 7. FIG. 9 shows a simplified cross-sectional view taken along the lines 9—9 of FIG. 8.

Referring now to FIGS. 6–9, a two-way switchable divider/combiner 70 includes a common port connector 72 and port 1 (P1) and port 2 (P2) connectors 74 protruding out of an electrically conductive housing 76. The connectors 72 and 74 are generally coaxial RF connectors, such as N-type or SMA connectors, but can be any type of RF connectors suitable for use with the 50-ohm transmission lines. The housing 76 is preferably constructed of aluminum alloy, such as the one known in the industry as A1 6061-T6, typically finished with nickel or silver plate. The housing 76 encloses all components of the device other than external interfaces, and acts as an electromagnetic shield preventing RF leakage from the device while protecting the internal circuitry from external electromagnetic interferences.

The common port connector 72 extends to a first coaxial transmission line 78 having a characteristic impedance $Z_0$ equal to 50 ohms. The first coaxial transmission line 78 includes a first center conductor 80 the end of which forming a first RF contact 82.

The switchable divider/combiner 70 further includes two second coaxial transmission lines 84 each disposed along the axis of the P1 and P2 connectors 74, respectively, and opposingly located at an equal distance from the first coaxial transmission line 78. Each second coaxial transmission line 84 includes a second center conductor 86 the end of which forming a second RF contact 88. The first RF contact 82 and both of the second RF contacts 88 are disposed in a substantially planar configuration in an air-filled RF cavity 90 at a substantially equal distance from the enclosing longitudinal walls 92 of the RF cavity 90. The RF cavity 90 is sealed on the top by an electrically conductive cover plate 94.

RF connections between the first coaxial transmission line 78 and two second coaxial transmission lines 84 are accomplished by two electrically conductive reeds 96 having a first end and a second end. The reeds 96 are typically constructed of gold-plated beryllium copper alloy which provides excellent wear and RF qualities. Each reed 96 is movably placed beneath the bottom of the cover plate 94 and above the first RF contact 82 and the second RF contact 88 in alignment therewith, and is adapted to individually make or break contact with the first RF contact 82 at its first end, and with the second RF contact 88 at its second end. The reeds 96 and the enclosing longitudinal walls 92 of the RF cavity 90 are dimensioned such that, when connected to the respective second coaxial transmission line 84, they form, in conjunction therewith, continuous transmission lines having a characteristic impedance Z=60.4 ohms and an electrical length of one-quarter wavelength at the selected operating frequency.

Each second coaxial transmission line 84 is further connected to a third coaxial transmission line 98 and a power resistor 100 at an junction 102. The third coaxial transmission lines 98 have a characteristic impedance of 50 ohms and are coupled to the P1 and P2 connectors 74, respectively. It is generally desirable that the power resistors 100 have sufficient power handling capabilities. Therefore, the power resistors 100 are mounted on a beryllium oxide substrate 103 having a high thermal conductivity in order to effectively handle the heat dissipation in the power resistors 100. It is also desired that the power resistors 100 be minimally capacitive. As the typical alumina power resistors possess a relatively high shunt capacitance, typically in the range of 0.7 to 1.4 pF, some tuning of the power resistors or their associated interconnections may be required to minimize the effects of the shunt capacitance of the power resistors. In the presently preferred embodiment, each power resistor 100 is enclosed by two opposing air cavities 104, 105 to suppress the shunt capacitance to a minimum level.

The switchable divider/combiner 70 further includes two airline coaxial transmission lines 106 each connected, at one end, to the power resistor 100 and, at the other end, making an coaxial-to-microstrip transition. Each printed transmission line 110 formed onto a first dielectrics substrate 112 connects the respective airline coaxial transmission line 106 to a mechanical shorting relay 116. Each shorting relay 116 disposed on the first dielectric substrate 112 makes or breaks an electrical connection between the printed transmission line 110 and a common node 118. The shorting relays 116 of the present embodiment are constructed of beryllium copper alloy and normally remains in the closed switch position, making the electrical connection with the common node 118. The combined electrical length of the airline coaxial transmission line 106, the printed transmission line 110, and the shorting relay 116 may be adjusted to optimize the impedance matching and isolation between the P1 and P2 ports. In the presently preferred embodiment, the combined electrical length of 106, 110, and 116 is approximately one-half wavelength at the selected operating frequency.

As shown in FIG. 8, the movement of the reed 96 within the RF cavity 90 is facilitated by a non-conducting, dielectric pushrod 120 fixedly attached to the reed 96 and inserted through an aperture 122 formed onto the cover plate 94. The aperture 122 guides the pushrod 120 and the attached reed 96 in straight up and down movement. The pushrod 120 is spring loaded by a spring 124 captured between the cover plate 94 and a pushrod cap 126 at the top of the pushrod 120. When a force is applied to depress the pushrod 120, the spring 124 becomes sufficiently depressed, permitting the reed 96 to bridge across the first RF contact 82 and the second RF contact 88. When such a force is removed subsequently, the spring 124 pushes back the pushrod cap 126, thereby returning the push rod 120 and the reed 96 to their original "unpushed" position.

The presently preferred embodiment of the present invention utilizes an electromechanical actuating arrangement for switching the reed 96 between the closed and open switch positions. Such actuating arrangement is well known in the microwave switch industry and generally comprises, as shown in FIG. 8, a first solenoid 128, a second solenoid 130, a permanent magnet 132 disposed therebetween, and a metallic clapper 134 pivoting in response to the magnetic field created alternatingly by the first solenoid 128 and the second solenoid 130 interacting with the permanent magnet 132. The clapper 134 is pivotally mounted with a dielectric dowel pin 136 on a support post 138 fixedly secured to the cover plate 94.

In operation, when an electrical current is applied to the first solenoid 128, it creates a magnetic field which pulls the first end 140 of the clapper 134 towards the first solenoid 128, which causes the second end 142 of the clapper 134 to rotate in an opposite direction, thereby depressing the pushrod 120 and the attached reed 96 for short-circuiting the first RF contact 82 and the second RF contact 88. Likewise, when an electrical current is thereafter applied to the second solenoid 130, the second end 142 of the clapper 134 rotates toward the second solenoid 130, thereby releasing the pushrod 120 and the reed 96 to the open-circuiting position. Thus, it can be seen that the reed 96 and the elements associated therewith, together with the interacting electromechanical actuating arrangement, constitute the first switch 38 in FIG. 4.

Similarly, an actuating arrangement needs to be provided for switching the shorting relay 116 between the closed and open switch positions. However, adding an extra actuating arrangement for each shorting relay 116 will result in an increase in the manufacturing cost and design complexity. Instead, the present invention provides a compact, cost effective design which utilizes a common actuating arrangement for simultaneously switching each pair of the reed 96 and the shorting relay 116 of the same dividing/combining channel. Referring to FIG. 8, the present embodiment provides a dielectric relay rod 144 disposed in a guiding post 146 at the center of the second solenoid 130. The guiding post 146 is in alignment with a hole 148 formed onto the first dielectric substrate 112 and disposed underneath the shorting relay 116. In the closed switch position, the relay rod 144 is uprightly positioned underneath the first dielectric substrate 112 and suspended on the second end 142 of the clapper 134 by the guiding post 146. The length of the relay rod 144 is such that, when the second solenoid 130 is energized, the relay rod 144 pushed up by the second end 142 of the clapper 134 moving toward the second solenoid 130, in turn pushes up the shorting relay 116 for disengagement from the common node 118. Likewise, when the first solenoid 128 is energized, the first end 140 of the clapper 134 is pulled toward the first solenoid 128 and, as a result, the relay rod 144 returns to the original position as the second end 142 of the clapper 134 rotates back to push down the pushrod 120, enabling the shorting relay 116 to return to the original closed switch position. Thus, it can be seen that the shorting relay 116 and the associated elements, with the interacting common actuating arrangement, define the second switch 52 in FIG. 4.

The use of a common actuating arrangement is further advantageous in that the switching of both the first and second switches in each dividing/combining channel is simultaneous and can be controlled by one control signal. It also enables each pair of the first and second switches to operate always in the same switch position, as is usually required for an optimal operation of the present invention.

The presently preferred embodiment further includes means for controlling the switch positions of the first and second switches. Referring to FIG. 8, a terminal 150 has a plurality of control ports for receiving a plurality of control signals from the external circuitry. Control circuits 152 formed onto a second dielectric substrate 154 receive the control signals from the terminal 150 and supply voltages in response thereto to the first and second solenoids 128, 130 for energizing respective solenoids. In present embodiment, two control ports are provided for each pair of the first and second solenoids 128, 130 so that a single 24-volts DC control signal alternatingly applied to each of the two control ports actuates the corresponding pair of the first and second switches simultaneously.

In addition, the present embodiment may include means for indicating to the external circuits the switch positions of each pair of the first and second switches. The techniques for installing an indicator circuit into microwave switching devices is well known in the art and, thus, will not be described in detail. In the present embodiment, the indicator means may be coupled to each pair of the first and second switch means to detect their respective switch positions and then relay the information to the control means for transmittal to the external circuits.

The presently preferred embodiment of the two-way switchable divider/combiner shown in FIGS. 6–9 may be generally implemented in any N-way configuration. As can be seen from FIG. 8, the two-way switchable divider/combiner comprises two identical dividing/combining channels opposingly disposed along an axis connecting the center conductors of the common port connector 72 and the common transmission line 78, and the common node 118. Similarly, an N-way configuration can be easily achieved by an assemblage of N identical dividing/combining channels radially disposed around the axis connecting the common junction and the common node and equally spaced apart from each adjoining one.

Figure 10:
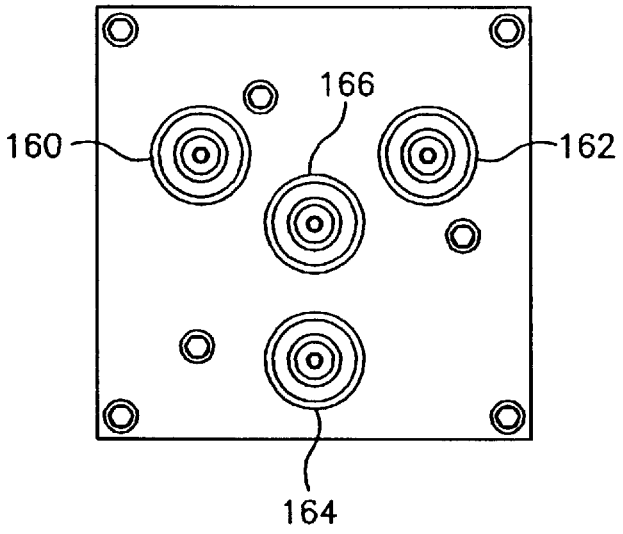
FIG. 10 is a front exterior view of the switchable power divider/combiner shown in a three-way configuration.
Figure 11:
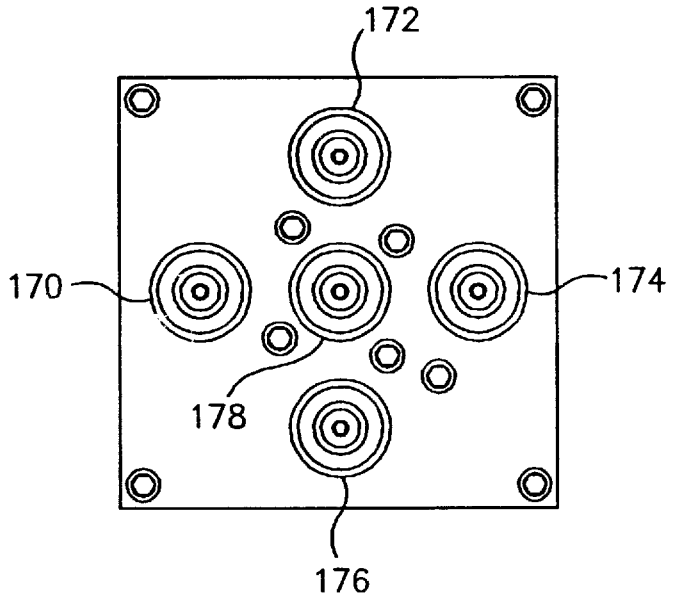
FIG. 11 is a front exterior view of the switchable power divider/combiner shown in a four-way configuration.

FIG. 10 and FIG. 11 show the front exterior views of the three-way and four-way switchable divider/combiner, respectively, constructed in accordance with the presently preferred embodiments. As can be seen from these figures, the input/output ports P1 160, P2 162, and P3 164 of the three-way configuration and P1 170, P2 172, P3 174, and P4 176 of the four-way configuration extend radially from the respective common port 166, 178 and are uniformly spaced at an equal distance from each adjoining input/output ports.

While the switchable divider/combiner of the present invention has been described with reference to its presently preferred embodiments, it will be apparent to those skilled in the art that the present invention can be implemented in various additional configurations and by utilizing other materials, mediums, devices, or structures exhibiting similar desirable characteristics or traits. In particular, the various transmission lines described in the present invention may be realized in any mediums suitable for RF transmission, such as coaxial, stripline, or microstrip lines. Likewise, the switching devices incorporated in the present invention need not be an electromechanical type. Instead, any appropriate solid state relays or switches, such as PIN diodes or GaAs switches, may be utilized. It should be also understood that the characteristic impedances of the dividing/combining transmission lines and the isolation transmission lines may be adjusted to obtain desired RF characteristics for a given application. In addition, the present divider/combiner can be packaged as a discrete unit, or incorporated within a larger dividing/combining network as an integral part thereof.

The switchable power divider/combiners of the present invention have been found to provide excellent electrical performance over the operating frequency range, in both N-way and (N−1)-way operating modes. The following table summarizes the typical RF performance characteristics of the two-way, three-way, and four-way divider/combiners of the present invention, over the selected frequency ranges of 869–894 MHz and 1.93–1.99 GHz.

TABLE OF PERFORMANCE

| Configuration/ Operating Mode | VSWR (max) | Insertion Loss (max) | Isolation (min) | Phase Deviation |
|---|---|---|---|---|
| 2-way (2-way mode) | 1.33 | 0.30 dB | 20 dB | <1.0 deg |
| 2-way (1-way mode) | 1.44 | 0.35 dB | 20 dB | <1.0 deg |
| 3-way (3-way mode) | 1.23 | 0.25 dB | 20 dB | <1.0 deg |
| 3-way (2-way mode) | 1.33 | 0.30 dB | 20 dB | <1.0 deg |
| 4-way (4-way mode) | 1.15 | 0.20 dB | 20 dB | <1.0 deg |
| 4-way (3-way mode) | 1.22 | 0.25 dB | 20 dB | <1.0 deg |

From the foregoing it should be evident that there has been described a new and advantageous multi-channel power divider/combiner whose modes of operation can be selectively controlled as needed. In particular, the present switchable power divider/combiner has been found to provide efficient power combining and distribution in a low-loss, phase-balanced manner, in both N-way and (N−1)-way operating modes, thus enabling the continuing operation of the power divider/combiner in the presence of a failed channel in the external circuitry.

These novel features of the present invention can be incorporated into multi-channel divider/combiner networks, greatly improving the power combining or distribution efficiency while, at the same time, enhancing reliability of the network in operation. As previously explained, when one of the N channels in a conventional divider network is disabled due to an arbitrary mode of failure, the power divider continues to distribute the power to the disabled channel and 1/N of the power is lost through the disabled channel. The present power divider can prevent such a loss of power by switching its mode of operation from N-way to (N−1)-way so that the corresponding divider channel coupled to the disabled channel is decoupled from the divider circuit.

Similarly, in a conventional N-channel power amplifier network, the failure of one of the power amplifiers has been shown to cause a substantial reduction in the combined output power, and degradation in the signal characteristics, critically affecting the overall efficiency and operability of the power amplifier network. The present power combiner can improve the combining efficiency, and assure continuing operability, of the power amplifier network in such a failure mode, by switching its mode of operation from N-way to (N−1)-way so that the combining channel coupled to the failed power amplifier is decoupled from the combiner circuit. As described previously, the present power combiner in the (N−1)-way mode can deliver a combined output at a power level reduced only by 1/N of the combined output power obtainable in the normal, N-way operating mode.

The operability and reliability of the power combining network can be further enhanced by providing a redundant channel to one of the N input ports of the present power combiner. Thus, in an N-channel power amplifier network including one redundant channel, the present power combiner can be controlled to operate in (N−1)-way in a normal operating mode, with all of the normally operational (N−1) power amplifiers, each outputting power $P_I$, coupled to the normally operative (N−1) combiner input ports, and the redundant power amplifier coupled to the remaining, normally non-operative Nth port, to produce the combined output power of $(N-1)P_I$. When one of the normally operational (N−1) amplifiers fails, the power combiner can decouple the combining channel associated with the failed amplifier and put the redundant combining channel into operation, thereby providing an (N−1)-to-1 redundancy to the power amplifier network without any decrease in the combined output power. This eliminates the need for elaborate pre-combiner redundancy arrangements, such as N-to-(N−1) switching matrices, presently used in many conventional multi-channel power amplifier networks.

In an alternate (N−1)-to-1 redundancy scheme, all of the N power amplifiers are coupled to the combiner operating in an N-way mode, and operate at an reduced power level of $(N-1)P_I/N$, where $P_I$ is the usual full operating power of the amplifiers, to produce the combined output power of (N−1) $P_I$. When one of the power amplifiers fails, the corresponding combining channel coupled to the failed amplifier is decoupled, and the operating output powers of the remaining (N−1) amplifiers are increased to the full operating power $P_I$, producing the combined output power of $(N-1)P_I$ in the (N−1)-way operating mode. The techniques for controlling the amplifier output powers are well known in the art and can be easily implemented by regulating amplifier gains or bias voltages. This arrangement is advantageous in that, in the normal operating mode, the power amplifiers can be operated at the reduced power level, thus improving intermodulation and other RF characteristics of the power amplifiers. Another advantage of this arrangement is that any failure of the normally non-operating redundant amplifier is instantly verified, as all of the N power amplifiers, including the normally redundant one, are operating in the normal operating mode.

In an another alternate redundancy arrangement, the present power combiner can provide a redundancy protection without requiring a separate redundant channel. For example, in a four-channel power amplifier network, four amplifiers each outputting 30 Watts, can be combined by the present power combiner operating in a four-way mode, to produce 120 Watts. When one of the power amplifiers fails, the present power combiner can be switched to a three-way mode upon receiving a failure-sensing signal, and the output powers of the remaining operational amplifiers can be upwardly adjusted to 40 Watts per channel, to produce 120 Watts of the combined power. Thus, by properly regulating the amplifier gains, the present invention can be adapted to provide a redundancy in a multi-channel power amplifier network without requiring a separate redundant power amplifier.

Thus, it will be apparent to those skilled in the art that the switchable power divider/combiner of the present invention affords great flexibility in designing dividing/combining network circuits, significantly simplifies their circuit design, and is capable of providing cost effective redundancy and reliability protection, while at the same time providing efficient combining and distribution of RF powers.

While this invention has been described with reference to its presently preferred embodiments, its scope is not limited thereto. It will now be apparent to one skilled in the art that many and various changes and modifications may be made without departing from the spirit and scope of the invention. It is intended, therefore, that all those changes and modifications as fairly fall within the scope of the appended claims be considered as a part of the present invention. The scope of the invention is only limited insofar as defined by the following set of claims and all equivalents thereof.

What is claimed is:

1. A power divider/combiner operable over a range of radio frequencies, comprising:

a common transmission line, one end of said common transmission line defining a common junction;

N input/output transmission lines, where N is an integer greater than 1, one end of each said input/output transmission line defining one of N input/output junctions;

N first switchable transmission line arrangements, each said first switchable transmission line arrangement including a first transmission line having one end coupled to a corresponding one of said N input/output junctions, each said first switchable transmission line arrangement further including a first switch disposed between the other end of said first transmission line and said common junction, said first switch adapted for making electrical connection between the other end of said first transmission line and said common junction in a closed switch position and breaking electrical connection between the other end of said first transmission line and said common junction in an open switch position;

N resistors, one end of each said resistor coupled to a corresponding one of said N input/output junctions;

N second switchable transmission line arrangements, each said second switchable transmission line arrangement including a second transmission line having one end coupled to the other end of a corresponding one of said N resistors, said second switchable transmission line arrangement further including a second switch disposed between the other end of said second transmission line and a common node, said second switch adapted for making electrical connection between the other end of said second transmission line and said common node in said closed switch position and breaking electrical connection between the other end of said second transmission line and said common node in said open switch position; and control means coupled to said first switch of each said first switchable transmission line arrangement and said second switch of each said second switchable transmission line arrangement for selecting one of said first and second switch positions.

2. A power divider/combiner operable over a range of radio frequencies, comprising:

a common transmission line, one end of said common transmission line defining a common junction;

N input/output transmission lines, where N is an integer greater than 1, one end of each said input/output transmission line defining one of N input/output junctions;

N first switchable transmission line arrangements, each said first switchable transmission line arrangement including a first transmission line having one end coupled to a corresponding one of said N input/output junctions, each said first switchable transmission line arrangement further including a first switch disposed between the other end of said first transmission line and said common junction, said first switch adapted for making electrical connection between the other end of said first transmission line and said common junction in a closed switch position and breaking electrical connection between the other end of said first transmission line and said common junction in an open switch position;

N second transmission lines, each second transmission line coupled between each successive pair of N connecting nodes to form a ring;

N switchable resistor arrangements, each said switchable resistor arrangement including a resistor having one end coupled to a corresponding one of said N input/output junctions, each said switchable resistor arrangement further including a second switch disposed between the other end of said resistor and a corresponding one of said N connecting nodes, said second switch adapted for making electrical connection between the other end of said resistor and said corresponding connecting node in said closed switch position and breaking electrical connection between the other end of said resistor and said corresponding connecting node in said open switch position; and control means coupled to said first switch of each said first switchable transmission line arrangement and said second switch of each said switchable resistor arrangement for selecting one of said first and second switch positions.

3. The invention of claim 1, wherein each said second switchable transmission line arrangement electrically connected between the other end of said corresponding resistor and said common node in said closed switch position of said second switch is substantially an integer multiple of a half-wavelength long at a selected frequency within the operating frequency range.

4. The invention of claim 2, wherein each said second transmission line is substantially an integer multiple of one-wavelength long at a selected frequency within the operating frequency range.

5. A power divider/combiner operable over a range of radio frequencies, comprising:

a common transmission line having a characteristic impedance equal to a selected impedance $Z_0$, one end of said common transmission line defining a common junction;

N input/output transmission lines, where N is an integer greater than 1, each said input/output transmission line having a substantially same characteristic impedance equal to said selected impedance $Z_0$, one end of each said input/output transmission line defining one of N input/output junctions;

N first switchable transmission line arrangements, each said first switchable transmission line arrangement including a first transmission line having one end coupled to a corresponding one of said N input/output junctions, each said first switchable transmission line arrangement further including a first switch disposed between the other end of said first transmission line and said common junction, said first switch adapted for making electrical connection between the other end of said first transmission line and said common junction in a closed switch position and breaking electrical connection between the other end of said first transmission line and said common junction in an open switch position, each said first switchable transmission line arrangement electrically connected between said common junction and said corresponding input/output junction in said closed switch position of said first switch is substantially a quarter-wavelength long at a selected frequency within the operating frequency range and has a substantially same characteristic impedance Z where Z is an impedance value between $Z_0$ and $\sqrt{N}Z_0$;

N resistors having a substantially same resistance $R_0$ equal to said selected impedance $Z_0$, one end of each said resistor coupled to a corresponding one of said N input/output junctions and the other end of each said resistor connected to a corresponding one of N connecting nodes;

N second switchable transmission line arrangements, each said second switchable transmission line arrangement including a second transmission line being inserted between each pair of N connecting nodes to form a ring, said each second switchable transmission line arrangement further including a second switch disposed between the other end of said each resistor and the corresponding one of said N connecting nodes; and control means coupled to said first switch of each said first switchable transmission line arrangement and said second switch of each said second switchable transmission line arrangement for selecting one of said first and second switch positions.

6. The invention of claim 5, wherein said characteristic impedance Z is an impedance value between $\sqrt{N}Z_0$ and $\sqrt{N-1}Z_0$.

7. The invention of claim 6, wherein said characteristic impedance Z is substantially equal to $(\sqrt{N}+\sqrt{N-1})Z_0/2$.

8. The invention of claim 7, wherein said selected impedance $Z_0$ is 50 ohms.

9. The invention of claim 5, wherein each said first switchable transmission line arrangement is substantially an odd integral multiple of a quarter-wavelength long at said selected frequency.

10. The invention of claim 5, wherein said first switch of each said first switchable transmission line arrangement in said open switch position is adapted to be disassociated from said common junction such that no portion of said first switch is in electrical contact with said common junction.

11. The invention of claim 1, wherein said second switch of each said second switchable transmission line arrangement in said open switch position is adapted to be disassociated from said common node such that no portion of said second switch is in electrical contact with said common node.

12. The invention of claim 11, wherein said first switch of each said first switchable transmission line arrangement and said second switch of each corresponding said second switchable transmission line arrangement are adapted for being actuated simultaneously so that said first switch and said corresponding second switch are always in the same switch position.

13. The invention of claim 1, wherein each said first switchable transmission line arrangement electrically connected between said common junction and said corresponding input/output junction in said closed switch position of said first switch is substantially a quarter-wavelength long at a selected frequency within the operating frequency range.

14. The invention of claim 13, wherein each said first switchable transmission line arrangement is substantially an odd integral multiple of a quarter-wavelength long at said selected frequency.

15. The invention of claim 11, wherein:

said common transmission line and said N input/output transmission lines have a substantially same characteristic impedance equal to a selected impedance $Z_0$;

each said first switchable transmission line arrangement electrically connected between said common junction and said corresponding input/output junction in said closed switch position of said first switch has a substantially same characteristic impedance Z, where Z is an impedance value between $Z_0$ and $\sqrt{N}Z_0$; and each said resistor has a substantially same resistance $R_0$ equal to said selected impedance $Z_0$.

16. The invention of claim 15, wherein said characteristic impedance Z is an impedance value between $\sqrt{N}Z_0$ and $\sqrt{N-1}Z_0$.

17. The invention of claim 16, wherein said characteristic impedance Z is substantially equal to $(\sqrt{N}+\sqrt{N-1})Z_0/2$.

18. The invention of claim 2, wherein each said first switchable transmission line arrangement electrically connected between said common junction and said corresponding input/output junction in said closed switch position of said first switch is substantially a quarter-wavelength long at a selected frequency within the operating frequency range.

19. The invention of claim 18, wherein each said first switchable transmission line arrangement is substantially an odd integral multiple of a quarter-wavelength long at said selected frequency.

20. The invention of claim 2, wherein:

said common transmission line and said N input/output transmission lines have a substantially same characteristic impedance equal to a selected impedance $Z_0$;

each said first switchable transmission line arrangement electrically connected between said common junction and said corresponding input/output junction in said closed switch position of said first switch has a substantially same characteristic impedance Z, where Z is an impedance value between $Z_0$ and $\sqrt{N}Z_0$; and each said resistor has a substantially same resistance $R_0$ equal to said selected impedance $Z_0$.

21. The invention of claim 20, wherein said characteristic impedance Z is an impedance value between $\sqrt{N}Z_0$ and $\sqrt{N-1}Z_0$.

22. The invention of claim 21, wherein said characteristic impedance Z is substantially equal to $(\sqrt{N}+\sqrt{N-1})Z_0/2$.

23. The invention of claim 1, wherein each line in the second switchable transmission line arrangement is substantially an integral multiple of a half-wavelength long at a selected frequency.

* * * * *